US005324015A

United States Patent [19]

Freitag

[11] Patent Number: 5,324,015

[45] Date of Patent: Jun. 28, 1994

[54] DEVICE FOR FEEDING SHEET MATERIAL TO A SHEET TRANSPORT SYSTEM LEADING DOWNSTREAM IN A MACHINE

[75] Inventor: Paul Freitag, Steinheim, Fed. Rep. of Germany

[73] Assignee: Siemens Aktiengesellschaft, Munich, Fed. Rep. of Germany

[21] Appl. No.: 74,880

[22] PCT Filed: Dec. 6, 1991

[86] PCT No.: PCT/EP91/02344

§ 371 Date: Jun. 7, 1993

§ 102(e) Date: Jun. 7, 1993

[87] PCT Pub. No.: WO92/10418

PCT Pub. Date: Jun. 25, 1992

[30] Foreign Application Priority Data

Dec. 7, 1990 [DE] Fed. Rep. of Germany ..... 4039146

[51] Int. Cl.[5] ..... B65H 5/26

[52] U.S. Cl. ..... 271/9; 271/117

[58] Field of Search ..... 271/9, 109, 110, 117

[56] References Cited

U.S. PATENT DOCUMENTS 4,570,919 2/1986 Huang ..... 271/9

4,744,687 5/1988 Nukaya ..... 271/9 X

FOREIGN PATENT DOCUMENTS 2717785 12/1978 Fed. Rep. of Germany .

3512068 10/1985 Fed. Rep. of Germany .

2022059 12/1979 United Kingdom .

*Primary Examiner*—Richard A. Schacher

*Attorney, Agent, or Firm*—Hill, Steadman & Simpson

[57] ABSTRACT

A device for feeding sheet material to a sheet transport system leading downstream in a machine, for example a printer, comprises a plurality of sheet material magazine stations, each of which is provided with a feed channel leading into the sheet transport system and with at least one friction roller set which can be selectively driven or stopped. Provision is made for the friction roller sets (28, 50) of the various magazine stations (2, 4) to be provided in each case with a mechanical clutch (72, 74) enabling them to be selectively coupled to a common drive motor, and for the clutches (72, 74) each to be provided with a clutch actuator ( 88, 96 ) cooperating with a control cam member (38 ) common to all the actuators (88, 96 ) and connected to a servomotor (108). In this way a plurality of friction roller sets can be operated with a single servomotor.

12 Claims, 3 Drawing Sheets

DEVICE FOR FEEDING SHEET MATERIAL TO A SHEET TRANSPORT SYSTEM LEADING DOWNSTREAM IN A MACHINE

BACKGROUND OF THE INVENTION

1. Field of the Invention

The invention relates to a device for feeding sheet material in single sheet form or web form to a downstream processing station in a machine, for example a printer, comprising a plurality of friction roller sets which are each allocated to a sheet material magazine station and are each able to be coupled via an associated clutch to a common drive motor.

The machines in question may be printers which for example are to print different types of paper, or else automatic cash dispensers which are to dispense different banknotes.

2. Description of the Related Art

From German Patent Application 39 07 146 A1 a device for feeding sheet material in single sheet form or web form to a downstream processing station in a machine, for example a printer, comprising a plurality of friction roller sets which are each allocated to a sheet material magazine station and are each able to be coupled via an associated clutch to a common drive motor is already known for a printer having a plurality of paper wells. Each paper well is allocated a friction roller set which is brought into engagement when required in order to convey a sheet through the appertaining feed channel into the sheet transport system leading downstream. The sheet transport system leading downstream comprises a plurality of friction roller pairs continuously coupled to a transport motor. Since the friction roller sets allocated to the individual paper wells should each be operated only singly and intermittently, they cannot be continuously connected for rotation to the drive motor. Consequently, they have their own clutches, each of which is connected to its own drive and which are intermittently operated by a control means. In a machine having a plurality of magazine stations the number of drives required is thereby increased, so that a complicated construction, large overall dimensions and high cost of the machine result.

SUMMARY OF THE INVENTION

The problem underlying the invention is that of providing a device for feeding sheet material in single sheet form or web form to a downstream processing station in a machine, for example a printer, comprising a plurality of friction roller sets which are each allocated to a sheet material magazine station and are each able to be coupled via an associated clutch to a common drive motor which needs a number of drives which is smaller than that in the known solution and is independent of the number of magazine stations provided, so that all in all smaller overall dimensions and lower construction costs are achieved.

According to the invention, this problem is solved by providing clutches each with a clutch actuator which cooperates with a control cam arrangement common to all the actuators, the friction roller sets are each able to be moved, with the aid of an associated shift member, between a pressure position and a liftoff position, the shift members cooperating with a common control cam arrangement, and the control cam arrangements for the actuators and the shift members are combined in a single control cam member which is connected to a drive motor whose direction of rotation is preferably reversible.

The friction roller sets of the individual magazine stations can each be connected selectively to a common drive motor with the aid of mechanical clutches. This motor may for example also be the drive motor for the sheet transport system leading downstream, because whenever sheet material is fed from one of the magazine stations the sheet transport system leading downstream must also always be put into operation. The clutches can be selectively controlled by associated clutch actuators. In order to give the clutch actuators the simplest possible construction and, in accordance with the problem posed, to achieve the greatest possible reduction of overall dimensions and construction costs, according to one feature of the invention provision is made for the clutch actuators of all the friction roller sets to cooperate with a single control cam member common to all the actuators and connected to a servomotor. In this way, irrespective of the number of magazine stations, it is possible to manage with a single drive motor for the drive and one servomotor for coupling all the friction roller sets.

As a further development of the invention provision is made for each of the friction roller sets to be mounted, in a manner known per se, for movement between a pressure position, in which it lies against back supports, and a lift-off position with the aid of an associated shift means; in order in this case also to achieve the simplest possible construction and therefore small overall dimensions and low construction costs, the shift means of all the friction roller sets in turn cooperate with a single control cam member connected to a servomotor.

For the further simplification of the device according to the invention the control cam members for actuating the clutches, on the one hand, and for shifting, on the other hand, are combined to form a single control cam member, which is driven by a servomotor. In this way, although the friction roller sets can be swivelled to a lift-off position, a separate control cam member and an additional servomotor are not required.

In order to enable a single control cam member to carry out the various control tasks, according to the invention provision is made for the control cam member to be in the form of a control roller mounted for rotation about its axis and for axial surfaces lying transversely to the roller axis, on the one hand, and peripheral surfaces, on the other hand, to be formed as control surfaces.

In a machine having two magazine stations provision is made, according to a preferred embodiment, for the clutches to have a common driving clutch disk which is connected for rotation to the drive motor and with which are associated two driven clutch disks, which are disposed one on each side of the driving clutch disk, are coaxial with the latter and are movable in the direction of the disk axis and each of which is drivingly connected to one of the friction roller sets; the driving clutch disk and the driven clutch disks each have cooperating coupling surfaces. The driving clutch disk disposed between the driven clutch disks can turn continuously during a sheet transport operation, the driven clutch disks being coupled and uncoupled respectively as required. Since the driving clutch disk idles when the friction roller sets are uncoupled, it can also without difficulty be connected to the main motor for the sheet transport system leading downstream.

The driven clutch disks are preferably each preloaded by spring means in the direction of the driving clutch disk, the spring means determining the coupling force. For uncoupling purposes the driven clutch disks are moved in the axial direction out of engagement with the driving clutch disk by means of control levers acting on them; the control levers are operated by the associated control cam member, as will be explained more fully with the aid of an example of embodiment.

The friction roller sets are each swivelable to a lift-off position, for example in order to facilitate the insertion of sheet material between the friction rollers and the back supports or to prevent any action by the friction rollers on sheet material passing through when the sheet material has been gripped by the sheet transport system leading downstream. According to a further development of the invention the friction roller sets comprise in a manner known per se one or more rollers, each mounted by means of a carrier arm on a swiveling shaft, the shift members being formed in each case by a shift lever which is connected to a swivel pin and cooperates with the associated control cam member.

As previously mentioned, the control cam member for actuating the clutches and the control cam member for shifting the friction rollers are preferably combined to form a single control cam member, which is connected to a servomotor, preferably a reversible stepping motor. In this way the control cam member can for example be moved in two directions of rotation from a neutral middle position, one of the two friction roller sets being operated for each direction of rotation, as will be explained more fully with the aid of the example of embodiment.

In order to determine the rotary position of the control cam member at a given moment, sensor members are preferably embedded in the cam member and cooperate with sensor members disposed outside the control cam member; the sensor members are connected to a control means which moves the adjusting motor to the respective positions with the aid of the signals coming from the sensor members.

In a further development of the invention provision is made for at least some of the control cams of the control cam members to be provided with rotation limiting stops, against which the cam follower member cooperating with the control cams comes to lie in a selected end position of the control cam member. The rotation limiting stops ensure absolutely accurate rotational angle positions for the control cam member.

BRIEF DESCRIPTION OF THE DRAWINGS

Further details, advantages and features will be seen in the following description and in the drawing, to which express reference is made in respect of the disclosure of all details not described in the text. One example of embodiment of the invention is illustrated in the drawing and described more fully below. In said drawing.

DETAILED DESCRIPTION OF THE PREFERRED EMBODIMENTS

Figure 1:
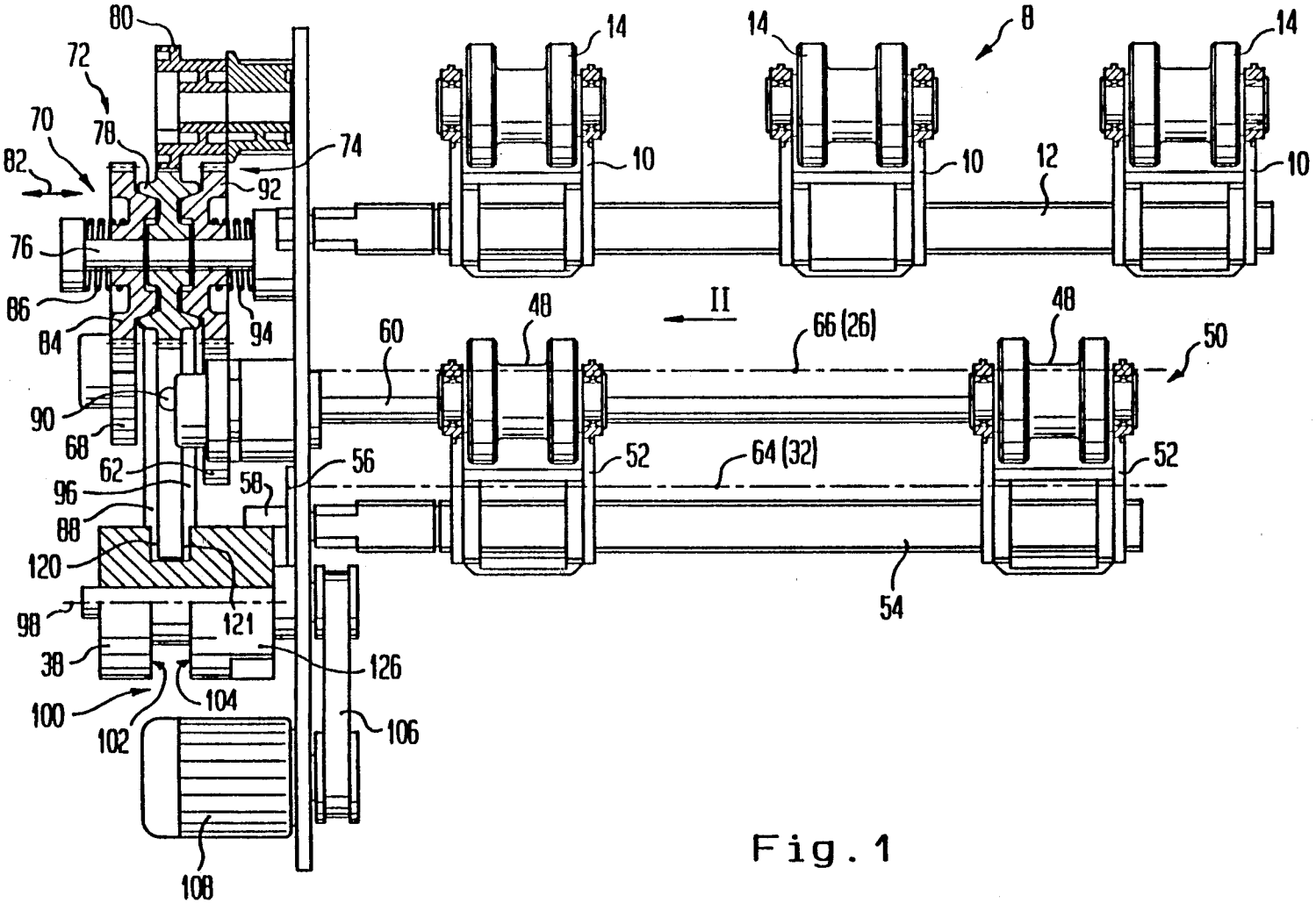
FIG. 1 shows schematically a plan view of a part of a machine comprising two friction roller sets and devices for coupling the friction rollers to a drive motor and for lifting the friction rollers off their back supports.
Figure 2:
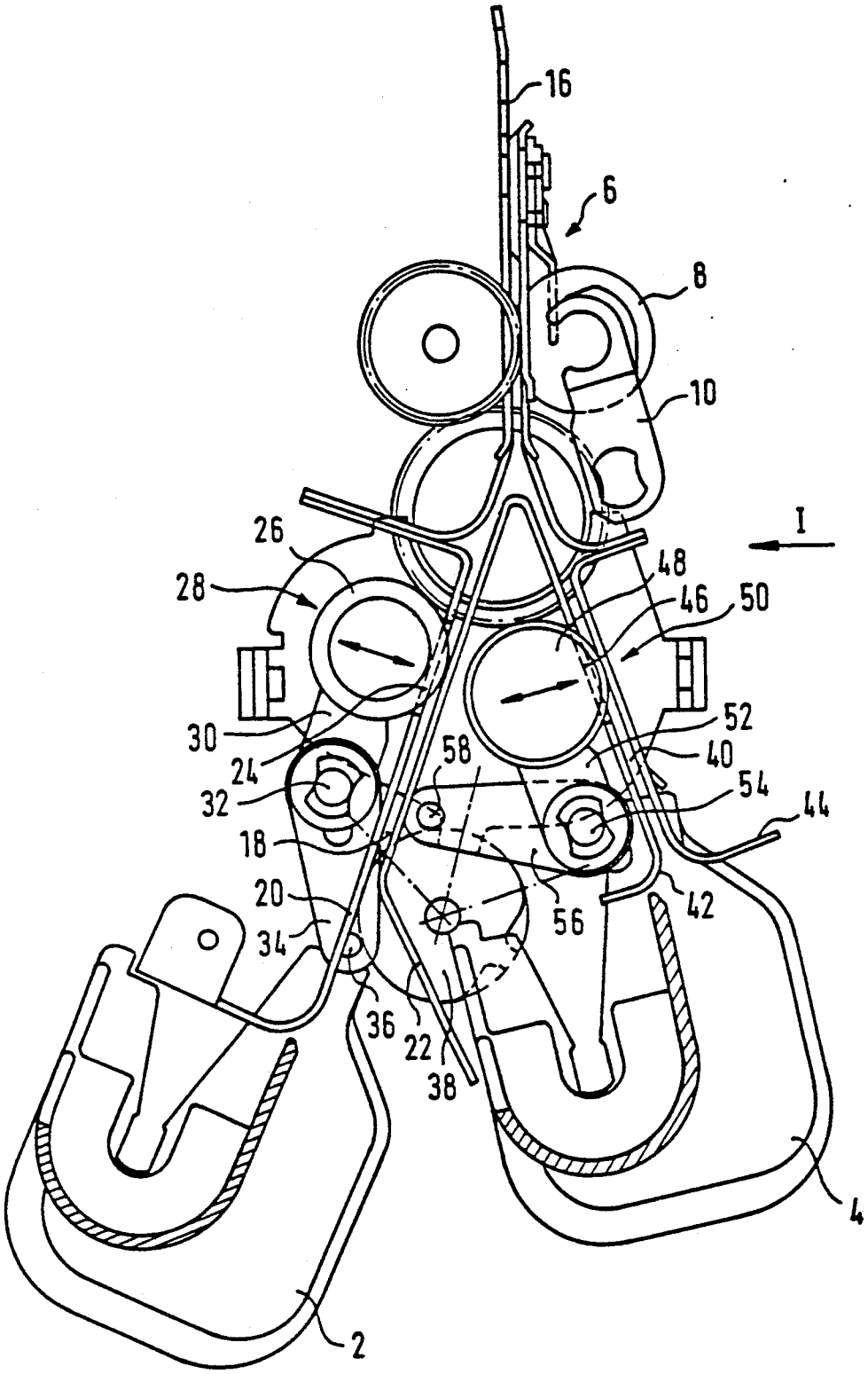
FIG. 2 is a schematic view, in the direction of the arrow II, of the device shown in FIG. 1.

FIGS. 1 and 2 show schematically a part of a printer provided with two magazine stations 2 and 4, from which sheet material in band form can be fed alternately to the sheet transport system 6 leading downstream in the printer. In FIG. 1, which shows approximately a view in the direction of the arrow I in FIG. 2, a friction roller set 8 is shown which belongs to the sheet transport system and consists of three rollers 14 mounted by means of carrier arms 10 on a swiveling shaft 12; the friction roller set 8 can be lifted off a plate 16, serving as back support, through the turning of the swiveling shaft 12, so that sheet material can be inserted between the rollers 14 and the plate 16. In a manner known per se the rollers 14 can be driven by a flexible shaft which connects all the rollers to a drive and which does not hinder the lifting-off movement of the rollers 14.

The magazine station 2 is connected by a feed channel 18 to the input of the sheet transport system 6. This feed channel 18 is substantially formed by two parallel plates 20 and 22. In the region close to the magazine station 2 the plates 20, 22 form a receiving hopper for the sheet material. The plate 20 has apertures 24, through which the rollers 26 of a friction roller set, given as a whole the reference 28, can engage. The plate 22 serves as a back support for the rollers 26. The rollers 26 are fastened by means of carrier arms 30 on a profiled swiveling shaft 32, so that through the turning of the swiveling shaft 32 they can be swiveled from the pressure position shown in FIG. 2, in which they lie against the back support 22, into a lift-off position, in which they free the feed channel 18. A shift lever 34 serving as shifting member is fastened to the swiveling shaft 32 and carries at its free end a cam follower pin 36 cooperating with a control cam member 38. A rotation of the control cam member 38 enables the friction roller set 28 to be selectively moved into its pressure position or its lift-off position.

The second magazine station 4 has a feed channel 40, which leads into the inlet of the sheet transport system 6. The feed channel 40 is likewise formed by two parallel plates 42, 44, which in their region close to the magazine station 4 form a receiving hopper, as shown in FIG. 2. The plate 42 on the left in FIG. 2 is provided with apertures 46, through which friction rollers 48 of a friction roller set, given as a whole the reference 50, can engage. The friction rollers 48 are mounted by means of carrier arms 52 on a common, profiled swiveling shaft 54, so that through the turning of the swiveling shaft 54 the friction rollers 48 can be moved between a pressure position and a lift-off position. A shift lever 56 serving as shift member is connected to the swiveling shaft 54; its free end carries a cam follower pin 58, which cooperates with the control cam member 38, as can also be seen in FIG. 1.

The friction rollers 48 can be driven by means of a common flexible shaft 60 which does not hinder the shift movement of the friction roller set 50. At its left-hand end in FIG. 1 the flexible shaft 60 carries a drive pinion 62 which can be coupled to a drive motor in a manner described further on.

In FIG. 1 the friction roller set 28 at the rear, viewed in the direction of the arrow I (see FIG. 2), is shown incomplete for the sake of greater clarity; the dot-dash line 64 symbolizes the axis of the swiveling shaft 32, and the dot-dash line 66 symbolizes the axis of the friction rollers 26 or of a flexible shaft which drives them and which, likewise at its left-hand end in FIG. 1, carries a drive pinion 68, which can be coupled to a drive motor in a manner described further on.

The coupling arrangement 70 forms two clutches 72 and 74 for coupling the drive pinions 68 and 62 respectively to a drive motor. It comprises a driving clutch disk 78, which is rotatably mounted on a bearing shaft 76 and meshes with a drive pinion 80 driven by a drive motor (not shown) by means of external teeth. The drive pinion 80 may for example be connected to the drive motor by means of a belt drive.

The first clutch 72 comprises a driven clutch disk 84 which is mounted on the bearing shaft 76 in a manner which allows rotation and displacement in the direction of the double arrow 82, and which meshes with the driven pinion 68 by means of external teeth. The driven clutch disk 84 is preloaded in the direction of the driving clutch disk 78 by a helical spring 86 coaxial to the bearing shaft 76.

A control lever 88 swivelable about an axis 90 at right angles to the plane of the drawing in FIG. 1, engages between the driving clutch disk 78 and the driven clutch disk 84. On swiveling in the counterclockwise direction the control lever 88 lifts the driven clutch disk 84 off the driving clutch disk 78 against the force of the helical spring 86. The driven clutch disk 84 is thereby on the one hand uncoupled from the driving clutch disk 78 and on the other hand braked by the control lever 88 which lies against the driven clutch disk 84. The end of the control lever 88 remote from the driven clutch disk 84 cooperates with the control cam member 38, which controls the swiveling movement of the control lever 88. The width of the teeth of the driven clutch disk 84, on the one hand, and of the driven pinion 68, on the other hand, is made such that in each shift position of the driven clutch disk they remain in mesh.

On the right-hand side of the driving clutch disk 78 (referring to FIG. 1) a driven clutch disk 92 is disposed, which is mounted on the bearing shaft 76 for rotation and for sliding in the direction of the double arrow 82, and which meshes with the driven pinion 62. It is preloaded in the direction of the driving clutch disk 78 by means of a helical spring 94 and can be uncoupled and braked by a control lever 96 which engages between the driving clutch disk 78 and the driven clutch disk 92, and which is likewise mounted for swiveling about the axis 90. The end of the control lever 96 remote from the driven clutch disk 92 cooperates in turn with the control cam member 38, which controls the swiveling movement of the control lever 96.

Figure 4B:
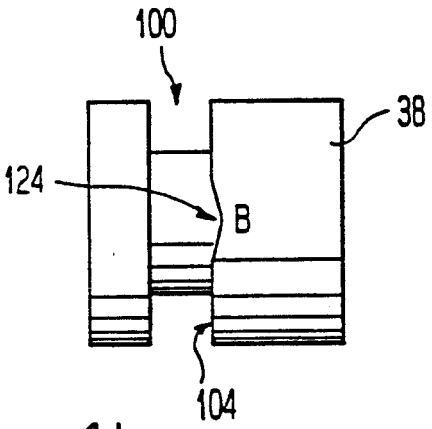
FIGS. 4*a*, 4*b* show a control cam member in two different side views.
Figure 4A:
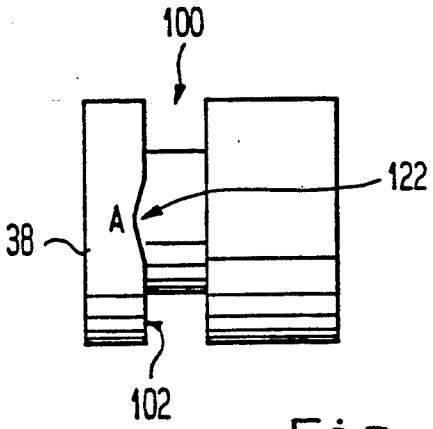

From the foregoing it is clear that through a corresponding adjustment of the control cam member 38 the friction roller sets 28 and 50 can be selectively coupled to a drive motor by means of the control levers 88 and 96 and can be selectively shifted to their pressure position or lift-off position by means of the shift levers 34 and 56 respectively. As can be seen in FIG. 1, the control cam member 38 is in the form of a control roller rotatable about its roller axis 98. It is provided with a peripheral groove 100, the two mutually facing axial surfaces 102 and 104 of which are in the form of control cams, as shown in particular in FIG. 4. The control cam member 38 is connected by a belt drive 106 to a stepping motor 108, which can be operated in both directions of rotation. At the right-hand end of the control cam member 38 in FIG. 1 a control cam 126 is formed on the peripheral surface, the shape of which cam is shown in particular in FIGS. 5 and 6. The cam follower pins 36 and 58 of the shift levers 34 and 56 respectively lie against the control cam. This control cam comprises two portions which are symmetrical to an axial plane of symmetry 110 of the control cam member 36, and which are each substantially allocated to one of the cam follower pins 36 and 58 and therefore form two control cams.

Figure 3:
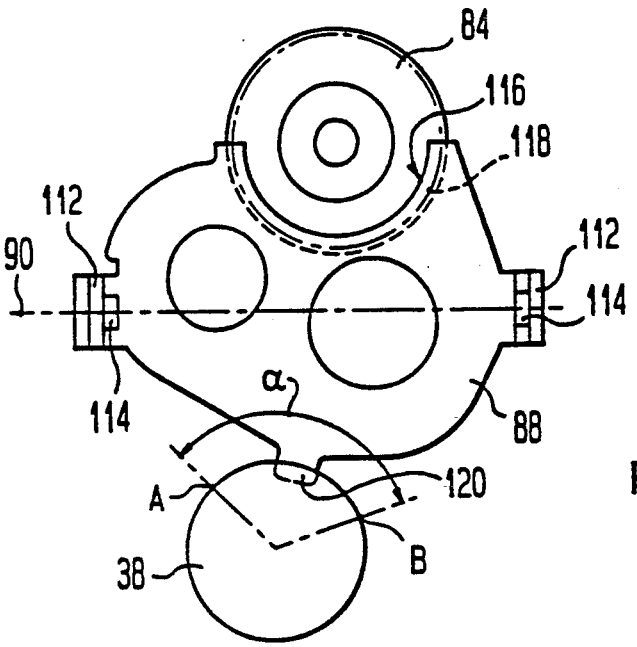
FIG. 3 shows a detail of FIG. 2.

FIG. 3 shows as an example the control lever 88. It is in the form of a stamped and bent sheet metal part. Two flaps 112, folded out of the plane of the drawing in FIG. 3, hold mounting pins 114, by means of which the control lever 88 can be swiveled about the axis 90 in a manner not further shown in the drawing. In its region lying at the top in FIG. 3 the control lever 88 has a semicircular cutout 116, which can bear against an edge region 118 of the associated driven clutch disk 84. This edge region 118 lies radially outside the coupling surface cooperating with the driving clutch disk 78. On the side of the control lever 88 lying at the bottom in FIG. 3 a projection 120 is formed, which engages in the peripheral groove 100 in the control cam member 38 and by means of the helical spring 86 is held bearing against the axial surface 102. When the projection 120 slides into the recessed region 122 on the rotation of the control cam member 38, the control lever 88 is swiveled in the clockwise direction in FIG. 1, so that the driven clutch disk 84 is coupled to the driving clutch disk 78. The second control lever 96 is substantially of similar construction to that of the control lever 88, so that it is unnecessary to repeat its description. When the projection 121 of the control lever 96 bearing against the axial surface 104 slides into the recessed region 124 of the axial surface 104, the control lever 96 is swiveled in the counterclockwise direction in FIG. 1, so that the driven clutch disk 92 is brought by the helical spring 94 to lie against the driving clutch disk 78 and is coupled to the latter.

The recessed regions 122 and 124 are offset by an angle $\alpha$ in the peripheral direction of the peripheral groove 100, as shown in FIG. 3. These two points are designated A and B respectively. When the control cam member 38 assumes the middle position shown in FIG. 3, the two projections 120 and 121 respectively lie on unrecessed regions of the appertaining axial surfaces 102 and 104 respectively. When the control cam member 38 is turned through an angle $\alpha/2$ in one direction or the other, one of the two projections 120, 121 penetrates in each case into the appertaining recessed region A or B respectively, so that in each case one of the two clutches 72 or 74 is coupled. These two positions will be referred to below as "position A" and "position B" respectively.

The control cam 126 formed on the peripheral surface of the control cam member 38, on the right-hand side of the latter in FIG. 1, is divided by the plane of symmetry 110 into two portions 126*a* and 126*b* symmetrical to the plane the cam follower pin 36 being associated with the portion 126*a* and the cam follower pin 58 with the portion 126*b*. The portion 126*a* has a recessed region 128 at one end. As long as the cam follower pin 36 lies on the unrecessed region of the portion 126*a*, the friction roller set 28 is swiveled in the clockwise direction in FIG. 5, that is to say is pressed against the plate 22. When the cam follower pin 36 slides into the recessed region 128, the friction roller set 28 is lifted off the plate 22 in the counterclockwise direction.

Figure 5:
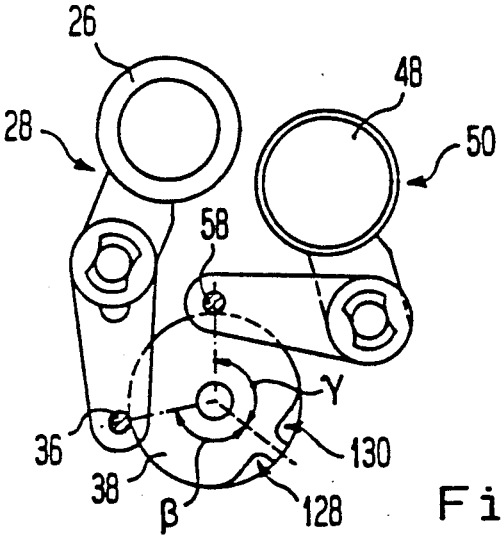
FIG. 5 shows a detail of FIG. 2.

Correspondingly, the portion 126*b* has a recessed region 130; when the cam follower pin 58 slides into the recessed region 130, the friction roller set 50 is swiveled in the counterclockwise direction in FIG. 5 and thus lifted off the plate 44 serving as back support.

Figure 6:
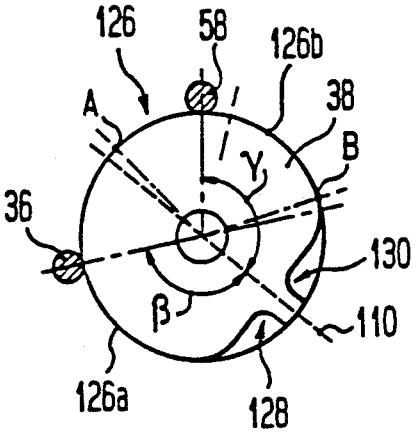
FIG. 6 shows a control cam member in a front view.

In FIGS. 5 and 6 the control cam 126 controlling the lifting-off of the friction roller sets 28, 50 is situated in a middle position, in which both friction roller sets 28 and 50 assume their pressure position. A rotation of the control cam member 38 through the angle $\beta$ lifts off the friction roller set 28, and a rotation through the angle 7 lifts off the friction roller set 50. In FIG. 6 the position of the points A and B in relation to the position of the control cam 126 is also shown once again.

The device functions as follows:

In the middle position of the control cam member 38 shown in FIG. 3 the two clutches 72 and 74 are open and the appertaining driven clutch disks 84 and 92 respectively are braked. At the same time the two friction roller sets 28 and 50 respectively are in their pressure position.

When paper material is to be fed from the magazine station 2 to the sheet transport system 6, the main motor is started up, so that the driving clutch disk 78 rotates. The control cam member 38 is then turned through an angle $\alpha/2$ by the stepping motor 108, and thus the clutch 72 is coupled and the friction roller set 28 is driven. As soon as the sheet material has been gripped by the sheet transport system 6, the control cam member 38 is turned further in the same direction, while the projection 120 of the control lever 88 moves once again away from the recessed region 124, so that the clutch 72 is released again; finally, the cam follower pin 36 passes into the recessed region 128 of the control cam 126, so that the friction roller set 28 is swiveled into the lift-off position. In this way the further transport of the sheet material is plainly effected solely by the sheet transport system 6, so that tensioning or arching of the sheet material is avoided. During the whole of this time the projection 121 of the other control lever 96 remains on an unrecessed region of the axial surface 102 and the cam follower pin 58 remains on an unrecessed region of the control cam 126, that is to say the clutch 74 is released and braked and the friction roller set 50 is in the pressure position, so that sheet material situated between the friction rollers 48 and the plate 44 is held fast.

When the feeding of sheet material from the magazine station 2 is to be terminated, the friction roller set 26 is applied again by turning back the control cam member 38, the direction of rotation of the main drive motor is reversed and the clutch 72 is engaged again until the sheet material has been pulled back sufficiently to prevent it from hindering the feeding of sheet material from the second magazine station 4.

For the purpose of feeding sheet material from the second magazine station 4, the control cam member 38 is turned in the other direction; otherwise, the operation proceeds in the manner already described.

The control cam member 38 can accordingly be shifted from the middle position shown in FIGS. 3, 5 and 6, in which both friction roller sets are in the pressure position, in the clockwise direction into the position A, in which the friction roller set 28 is coupled to the drive motor, and also into the end position which is defined by the recessed region 128 and in which the friction roller set 28 is uncoupled again and at the same time is in the lift-off position. In the same way the control cam member 38 can be turned in the counterclockwise direction into the position B, in which the friction roller set 50 is in the pressure position and coupled, and also into an end position which is defined by the recessed region 130 and in which the position.

Although other modifications and changes may be suggested by those skilled in the art, it is the intention of the inventor to embody within the patent warranted hereon all changes and modifications as reasonably and properly come within the scope of their contribution to the art.

I claim:

1. A device for feeding sheet material to a downstream processing station in a machine, comprising:
   - a plurality of friction roller sets which are each allocated to a sheet material magazine station;
   - a drive motor for said plurality of friction roller sets;
   - clutches each provided with a clutch actuator for each of said plurality of friction roller sets
   - shift members mounted for moving each of said plurality of friction roller sets between a pressure position and a liftoff position; and
   - a single control cam member having control cam arrangements in cooperative engagement in common with said clutch and having control cam arrangements in cooperative engagement in common with said shift members, said single control cam member being connected to said drive motor.

2. A device as claimed in claim 1, wherein said single control cam member comprises a control roller mounted for rotation about its roller axis, and axial surfaces lying transversely to the roller axis, on one hand, and peripheral surfaces, on another hand, are formed as control surfaces.

3. A device as claimed in claim 1, further comprising:
   - two magazine stations each associated with one of said plurality of friction roller sets;
   - a driving clutch disk of said clutches connected for rotation to said drive motor;
   - two driven clutch disks disposed one on each side of said driving clutch disk, positioned coaxial with said driving clutch disk and movable in a direction of a clutch disk axis, each of said two driven clutch disks being drivingly connected to one of said plurality of friction roller sets.

4. A device as claimed in claim 3, further comprising:
   - a drive pinion connected to said drive motor, said drive pinion meshing with said driving clutch disk by peripheral teeth
   - further drive pinions connected to corresponding ones of said plurality of friction roller sets and meshing with each of said drive clutch disks by peripheral teeth, a width of said peripheral teeth being in each case greater than an axial shift range of said driven clutch disks.

5. A device as claimed in claim 3, further comprising:
   - spring means for biasing each of said driven clutch disks in a direction of said driving clutch disk; and
   - a control lever for each of said driven clutch disks which acts on said clutch disk, said control lever being aligned substantially radially and being swivelable about a swivel axis extending substantially transversely to the clutch disk axis, said control levers cooperating with said control cam member.

6. A device as claimed in claim 5, wherein said control levers engage in each case between an associated one of said driven clutch disks and said driving clutch disk and bear against an edge region, lying radially outside coupling surfaces, of a respective one of said driven clutch disks.

7. A device as claimed in claim 5, wherein said control cam member comprises a control roller having a roller axis disposed parallel to the clutch disk axis and has a peripheral groove whose mutually facing facing axial surfaces are control cams for, in each case, one of said two control levers.

8. A device as claimed in claim 3, wherein said friction roller sets comprise in each case at least one roller mounted by a carrier arm on a swiveling shaft, and said shift members are each formed by a shift lever which is connected to a swiveling shaft and cooperates with said control cam member, and said shift lever connected to said swiveling shaft bearing by its free end against an associated control cam of said control cam member.

9. A device as claimed in claim 8, wherein said control cam member is disposed with a roller axis aligned parallel to said swiveling shaft, and said shift lever bears against a peripheral surface, formed as a control cam, of said control roller.

10. A device as claimed in claim 1, further comprising:

sensor members embedded in each case in said control cam member and cooperate with sensor members disposed under the control cam member to determine a rotational position of said control cam member, and a control means for operating said shift motor and connected to said sensor members.

11. A device according to claim 1, wherein at least some of said control cams of said control cam member are provided with rotation limiting stops, against which said cam follower member cooperating with said control cams comes to lie in a selected end position of said control cam member.

12. A device as claimed in claim 1, wherein said drive motor is reversible.

* * * * *